US005703571A

United States Patent [19]

Cannon et al.

[11] Patent Number: 5,703,571

[45] Date of Patent: Dec. 30, 1997

[54] SELECTIVE CALL TRANSCEIVER WITH CUSTOMIZED CANNED MESSAGES

[75] Inventors: Nancy Mondrosch Cannon; Gregory Lewis Cannon, both of Keller; David Patrick Kilp, Colleyville, all of Tex.

[73] Assignee: Motorola, Inc., Schaumburg, Ill.

[21] Appl. No.: 596,845

[22] Filed: Feb. 5, 1996

[51] Int. Cl.[6] ..... G08B 5/22

[52] U.S. Cl. ..... 340/825.44; 379/354; 455/38.4; 455/89

[58] Field of Search ..... 340/825.44, 825.47, 340/825.48; 379/57, 58, 59, 354; 455/32.1, 38.1, 38.4, 89

[56] References Cited

U.S. PATENT DOCUMENTS

| | | | |
|---|---|---|---|
| 3,976,995 | 8/1976 | Sebestyen | 340/825.44 |
| 4,618,860 | 10/1986 | Mori | 340/825.48 |
| 4,644,351 | 2/1987 | Zabarasky et al. | 340/825.44 |
| 4,951,044 | 8/1990 | Nelson et al. | 340/825.44 |
| 4,994,797 | 2/1991 | Breeden | 340/825.47 |
| 5,087,905 | 2/1992 | Kuramatsu | 340/825.44 |
| 5,257,307 | 10/1993 | Ise | 379/57 |
| 5,394,140 | 2/1995 | Wong et al. | 340/825.44 |
| 5,479,408 | 12/1995 | Will | 340/825.44 |
| 5,602,908 | 2/1997 | Fan | 379/354 |
| 5,604,492 | 2/1997 | Abdul-Halim | 455/32.1 |

*Primary Examiner*—Michael Horabik
*Assistant Examiner*—Edward Merz
*Attorney, Agent, or Firm*—John H. Moore

[57] ABSTRACT

A SCT (Selective Call Transceiver) (10) includes a memory (54) which stores a list (60) of addressees with whom the SCT user normally communicates. The memory also stores, for each of selected addresses, an associated group (62) of customized messages. The SCT (10) has a processor (18) that is programmed to permit the user to easily choose a customized message to be sent to an addressee, either by way of replying to a previously received message or by initiating transmission of a new communication.

12 Claims, 4 Drawing Sheets

ADDRESSEE LIST

DISPATCHER'S MESSAGE LIST

CO-WORKER'S MESSAGE LIST

PRESIDENT'S MESSAGE LIST

SPOUSE'S MESSAGE LIST

DEFAULT MESSAGE LIST

SELECTIVE CALL TRANSCEIVER WITH CUSTOMIZED CANNED MESSAGES

FIELD OF THE INVENTION

This invention relates generally to the field of RF (Radio Frequency) communication, and particularly to selective call transceivers that are useful in two-way, RF messaging systems.

BACKGROUND OF THE INVENTION

A typical two-way messaging system uses one or more base station transmitters and receivers to communicate with portable selective call transceivers. Messages for a particular selective call transceiver usually originate from a sender who calls his or her message in to the communication system via a public telephone network The system then transmits the message to the intended selective call transceiver.

A conventional selective call transceiver of the type under consideration has a memory in which it can store a list of addressees that the selective call transceiver is likely to communicate with on a regular basis. The memory may also store a number of so-called "canned" messages, any one of which may be selected by the user for replying to a message received from a sender.

Although this typical arrangement is workable, it does have a drawback in that the "canned" messages tend to be generic, as opposed to being customized for communicating with the particular individuals or organizations with whom the user of the selective call transceiver usually communicates. This drawback could be resolved by including in the list of "canned" messages certain messages that are especially composed, or customized, for communicating with particular individuals or organizations. However, with modern selective call transceivers having a relatively long list of addressees with whom they can communicate, the list of "canned" messages, including the customized messages, can become long, thus making it inconvenient and time consuming for the user to locate the desired message. Scrolling through a long list of "canned" messages is particularly inconvenient when the selective call transceiver has a small display which shows only a few lines of text. A selective call transceiver that can store customized messages in a way that is more convenient to use is clearly desirable.

DESCRIPTION OF THE PREFERRED EMBODIMENT

Figure 1:
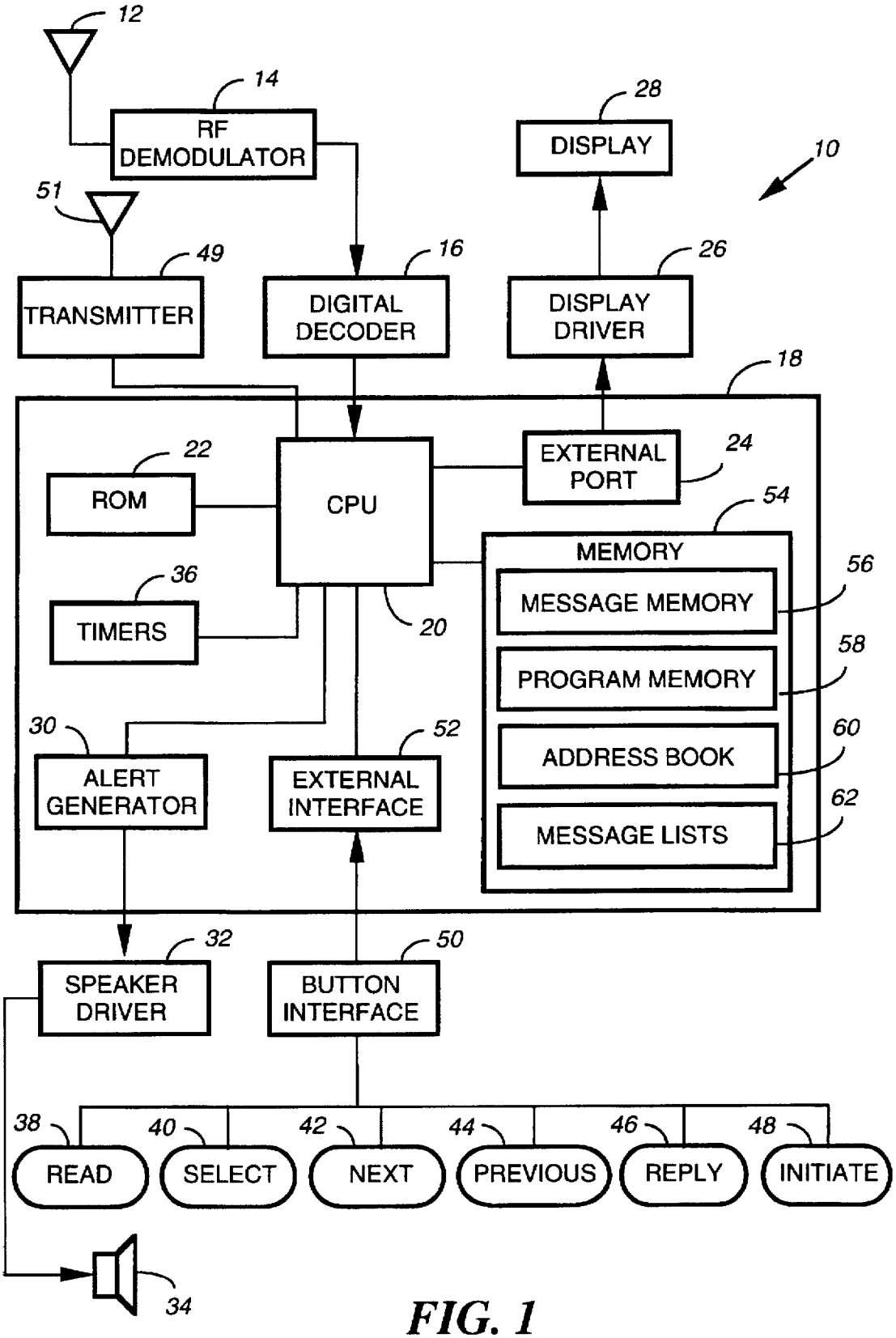
FIG. 1 is a block diagram of a selective call transceiver constructed in accordance with the invention.

Referring to FIG. 1, a selective call transceiver (sometimes referred to herein as SCT for brevity) 10 is shown which is programmed to operate in accordance with the invention. The illustrated SCT is shown in the form of a two-way pager, but the invention may be embodied in other forms of SCT's.

Messages originating from a sender and transmitted to the SCT are received and decoded by an antenna 12, a conventional RF demodulator 14, a conventional digital decoder 16 and a processor 18. The processor 18 includes a CPU (Central Processing Unit) 20 that controls the decoding process and other functions of the SCT.

The signal output from the decoder 16 is in the form of decoded digital data that is applied as an input to the processor 18 which may be, for example, a model MC68HC05 made by Motorola, Inc. Other suitable processors may also be used. Moreover, all of the hardware components, and the coding/decoding logic of the processor, may be conventional. It is our programming (described later) of the processor 20 and unique storage of "canned" messages which cause the SCT to operate in accordance with the invention.

The processor 18 includes a ROM (Read Only Memory) 22 which stores an instruction program for the CPU. The processor also includes an external port interface 24 for coupling signals from the CPU 20 to a display driver 26. The latter device drives a display 28, which may be a conventional liquid crystal display, for displaying decoded messages, menus, and the like.

To generate a user alert upon receipt of a message, the CPU is coupled to an alert generator 30 whose output is coupled to the input of a speaker driver 32. A speaker 34 is coupled to the output of the driver 32 for generating an audible alert upon receipt of a message that is directed to the SCT 10.

Timers 36 are coupled to the CPU 20 to give a time base for collecting data from the digital decoder 16 at precise intervals. They also keep time duration for alerts and possibly a real time clock for the user interface.

To allow the user to control various functions of the pager, a user control is included. In the illustrated embodiment, the user control takes the form of user actuatable buttons entitled Read 38, Select 40, Next 42, Previous 44, Reply 46 and Initiate 48. All these buttons are coupled to the CPU via a button interface 50 and an external port interface 52. The buttons may be used to cause a received message to be shown on the display 28 using the Read button 38, to scroll through messages using the buttons 42 and 44, to reply to a received message using the Reply button 46, to select a reply message using the Select button 40, and to initiate the transmission of a message using the Initiate button 48. It will be appreciated that the same functions can be implemented using different buttons and/or different combinations of buttons, depending on the preferences of the designer. Likewise, some or all of the buttons can be replaced by icons that are visible on the display 48. Such an icon may be selected by actuation of a select button or the like.

To permit the SCT 10 to be used in a transmit mode, a transmitter 49 is coupled to the CPU 20, the transmitter having an antenna 51.

The processor 18 also includes a non-volatile memory 54 that comprises the following stored elements: a message memory 56, a program memory 58, an address book 60 and message lists 62. The message memory 56 stores messages received by the SCT 10. The program memory 58 acts as a scratch pad memory for temporary storage of new messages (before being stored in message memory 56) and storage of the results of computations maple by the CPU 20.

The address book 60 and the message lists 62 contain information that is key to operating the SCT 10 in accordance with the invention, in cooperation with appropriate programming of the processor.

A key feature of the invention is that the SCT stores a customized list of "canned" messages, each such list being customized for, and associated with, a particular addressee. This advantageously allows the user to select from a relatively short list of customized responses when replying to a received message and when initiating the transmission of a message to an addressee. This will now be more fully explained with reference to FIGS. 1, 2 and 3.

Referring to FIG. 1, the memory 54 stores a list of addressees in the address book 60. The memory 54 also stores, for each of selected addressees, an associated group of customized messages in the message lists 62.

Figure 2:
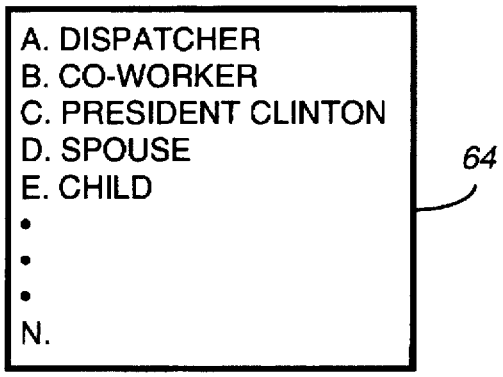
FIG. 2 illustrates an addressee list that is stored in the memory of the selective call transceiver of FIG. 1.

Referring now to FIG. 2, an addressee list 64 contains a list of individuals, organizations and/or things (such as sprinkler systems, vending machines, etc.) (addressees) with whom the user of the SCT 10 expects to communicate on a somewhat regular basis. This addressee list 64 is stored in the addressee book 60 (FIG. 1).

For each of selected addressees on the addressee list 64, the message lists 62 stores an associated group or list of customized messages. These groups of messages are identified as 66, 68, 70 and 72 in FIG. 3. For example, the message group 66 is a dispatcher's list that contains a number of messages that are associated with the dispatcher (addressee A in FIG. 2). In other words, the message list 66 contains pre-stored or "canned" messages that-are of the type that the user of the SCT 10 would ordinarily expect to use in communicating with a dispatcher.

Referring to the message list 68, it is a co-worker's message list that contains a number of messages that are associated with communication with a co-worker (addressee B in FIG. 2). Likewise, addressees C and D of FIG. 2 also have associated message lists 70 and 72.

It is not required that every addressee in the addressee list 64 have an associated message list. As an example, there is no corresponding message list for addressee E (Child) of FIG. 2. The point is that some or all of the addressees on the addressee list 64 will have corresponding message lists, depending on the amount of memory available in the SCT 10 and the preferences of the user.

It will be noted that a default message list 74 is included. This list is also stored in the message lists 62 of FIG. 1 and is discussed later.

With the processor 18 coupled to the transmitter 49, to the display 28 and having the memory 54, the processor is programmed to use the addressee list 64 and the message lists 66–72 so as to cause the display 28 to show, at the appropriate time, at least some of the customized messages in the list or group of messages (e.g., the list of dispatcher's messages 66) associated with a selected addressee (e.g., the dispatcher) to whom the SCT user wishes to send a message. The user control (such as the button 40) is coupled to the processor 18 for choosing one of the customized messages shown by the display 28. The processor is responsive to the user control for causing the transmitter 49 to transmit the chosen message (e.g., the message "Delivery Complete" in message list 66) to the one selected addressee (e.g., to the dispatcher).

The SCT 10 can operate as described immediately above in two modes. In one mode, the "reply" mode, the user desires to reply to a received message. The processor is programmed to determine whether the received message is from a sender who is a selected addressee, i.e., an addressee on the list 64 for whom there is an associated list of customized messages. (In FIG. 2, addressees A, B, C, and D are selected addressees because each of them has an associated list of customized messages. Addressee E (Child) is not a selected addressee because there is no associated list of customized messages for that addressee).

If the sender of the received message is determined to be a selected addressee, the processor's programming causes the display 28 to show at least some of the customized messages in the group of messages associated with the sender. The user can then select one of the displayed messages, and the processor 18 responds to the selection by causing the transmitter 49 to transmit the selected message to the sender.

Figure 4:
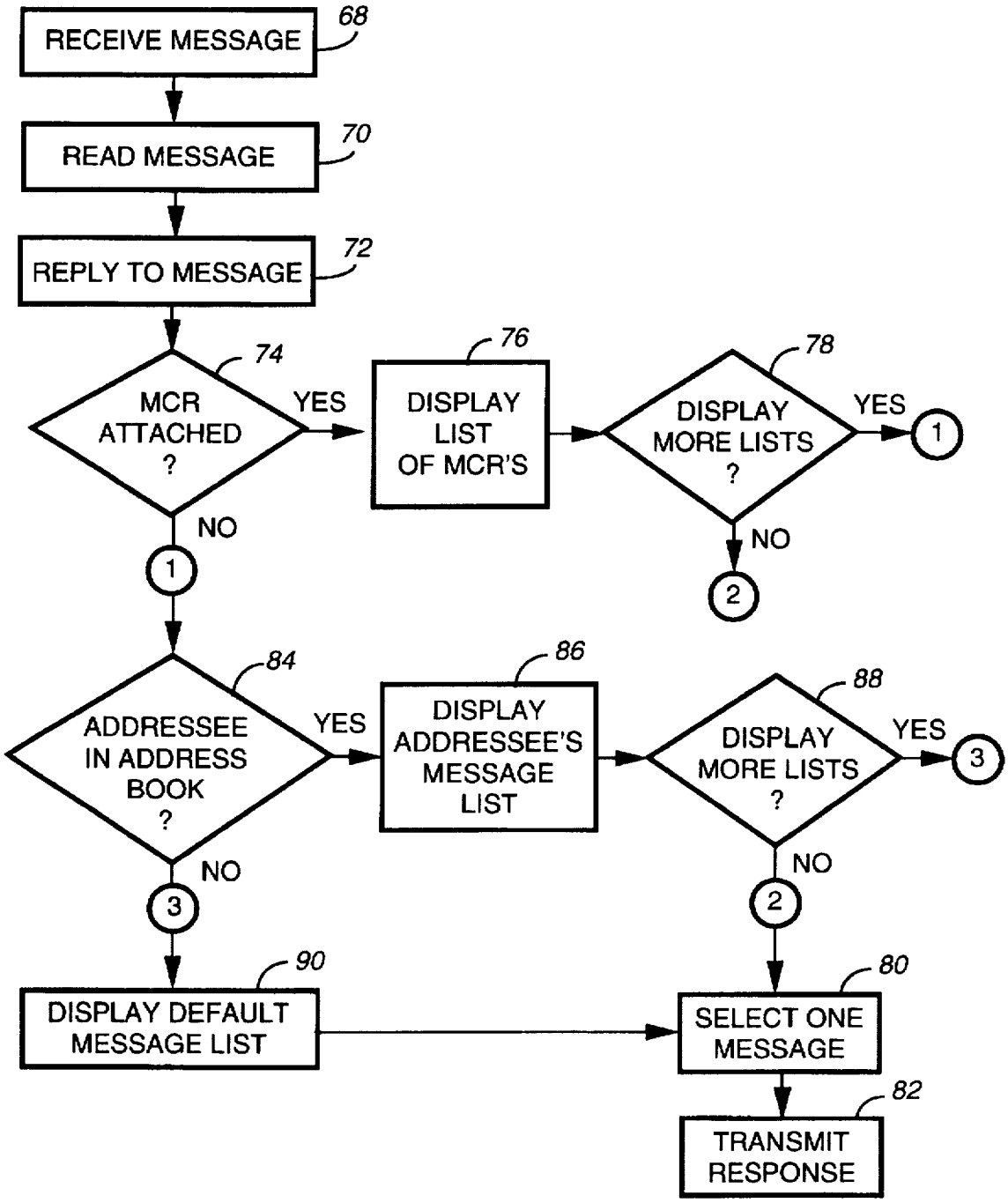
FIGS. 4 and 5 are flow charts illustrating how the selective call transceiver's processor is programmed to operate in accordance with the invention.

There are other ways of replying to a sender's message according to the invention. These will now be explained with reference to FIG. 4 which shows a flow chart illustrating how the processor 18 is programmed to cause replies to be selected and transmitted.

The flow chart begins with step 68 wherein the SCT 10 receives an incoming message from a sender. The SCT 10 will then typically alert the user that a message has been received, and the user may actuate the read button 38 (FIG. 1) to cause the received message to be displayed on the display 28. According to the next step 72, the user may initiate a reply to the received message by actuating the reply button 46 (FIG. 1). At this point, step 74 asks whether a multiple choice response (MCR) is attached to the received message. For example, a multiple choice response accompanying the received message might ask the SCT user to indicate whether the user would prefer meeting with the sender in the morning (choice 1), in the afternoon (choice 2) or in the evening (choice 3). If such a multiple choice response is attached to the received message, the program proceeds to step 76 and the processor 18 causes the display 28 to display the multiple choice responses.

Per the next step 78, the processor determines whether the user has previously selected the option of displaying more lists of "canned" messages from which to select a response (this option is selected or de-selected during initial set-up of the SCT). If the user did not select the option of seeing more lists, it is assumed that the user wishes to respond by choosing one of the multiple choice responses. Thus, the answer to the inquiry of step 78 is "no" and the program proceeds via node 2 to the next step 80. Now the user, using the select button 40, selects one of the multiple choice responses for transmission and, per the next step 82, the processor causes the transmitter 49 to transmit the selected response.

Referring back to step 78, if the user had previously selected the option of displaying more lists, the program proceeds from step 78, via node 1, to step 84. At this step, the processor determines whether the addressee of the proposed response (i.e., the sender in this case) is in the address book 60 (FIG. 1). If the answer is "yes", the program proceeds to step 86 for displaying that addressee's message list. For example, if the sender of the message was the dispatcher identified as addressee A in addressee list 64 (FIG. 2), the execution of step 86 would cause the dispatcher's message list 66 (FIG. 3) to be shown on the display 28.

Figure 3:
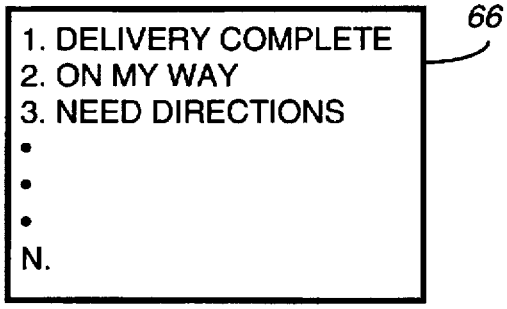
FIG. 3 illustrates several message lists that are stored in the memory of the selective call transceiver of FIG. 1.
Figure 3:
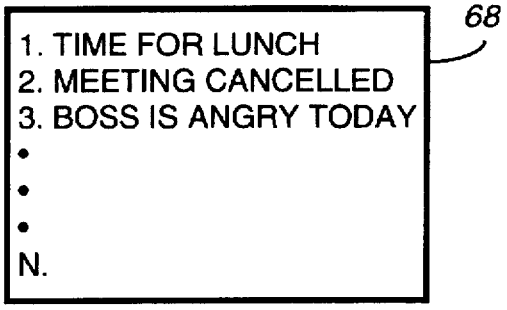
Figure 3:
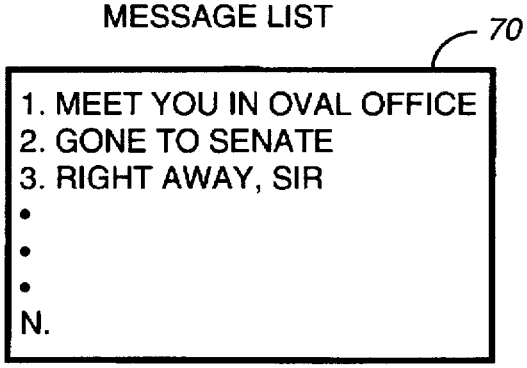
Figure 3:
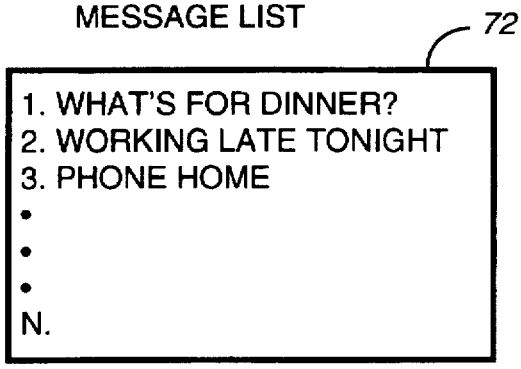
Figure 3:
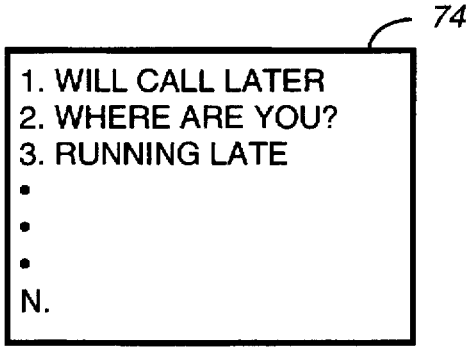

The next step 88 asks whether the user has selected the option of displaying more lists of possible messages for reply to the sender. If the answer is "yes", this indicates that the user does not wish to use one of the messages in the dispatcher's message list 66, and the program proceeds to step 90 which causes a default message list to be displayed. The default message list 74, shown in FIG. 3 is a list of messages or replies that are not necessarily customized for reply to any particular sender. Instead, they may be thought of as "generic" messages that could be suitable for replying to various types of senders.

Referring back to FIG. 4, the program proceeds from step 90 to step 80, whereby the user selects one message for reply, in this case from the default message list 74. The processor then causes the selected message to be transmitted per step 82.

Referring back to step 88, if the user had not selected the option of displaying more lists, the program would proceed from step 88 to step 80, permitting the user to select one message from the dispatcher's message list 66. The program then proceeds to step 82 for transmitting that selected message.

Refer back to step 74. In the case where no multiple choice response is attached to the received message, the program proceeds to step 84 to determine whether the addressee of the proposed reply is in the address book 60. Thereafter, the program proceeds through to step 82, as described above, for transmitting a response selected from the addressee's message list or from the default message list 74.

Figure 5:
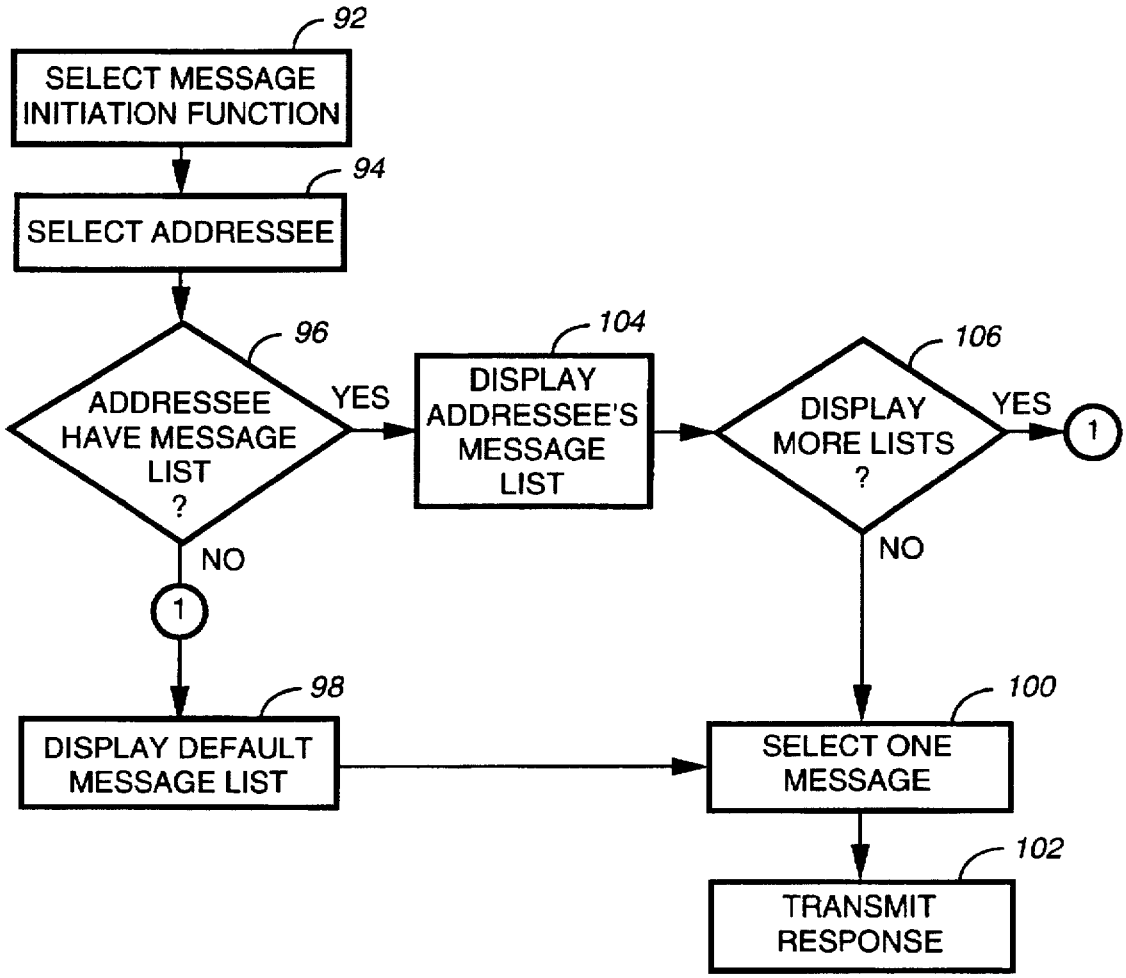

A second mode in which the SCT 10 operates is the "initiate" mode in which the user of the SCT initiates the transmission of a message to an addressee, as opposed to replying to a received message. The way in which the processor 18 is programmed to operate in the "initiate" mode will now be described with reference to FIG. 5.

The first step 92, the select message initiation function, involves the user actuating the initiate button 48 (FIG. 1). This starts the process of sending a selected canned message to a particular addressee. In the next step 94, the processor causes the display 28 to display the addressee list 64 (FIG. 2). The user now uses the select button 40 to select the addressee to whom a message will be sent.

Per the next step 96, the processor determines whether the selected addressee has a message list. As discussed before, addressees A–D of the addressee list 64 do have message lists, but the addressee E does not. Assuming that the selected addressee is the dispatcher, the answer to step 96 is "yes", whereupon the program proceeds to step 104 for displaying the addressee's (dispatcher's) message list, in this case the message list 66.

The next step 106 asks whether the user wants the SCT to display more lists. If the user selects "no", this indicates that the user desires to select a message from the message list displayed per step 104. At the next step 100, the user uses the select button 40 to select the message that the user desires to send. Per the next step 102, the processor causes the transmitter 49 to transmit the message selected by the user.

If, upon execution of step 106, the user desires to see an additional list of possible messages to send, as opposed to sending one from the message list displayed per step 104, the user selects "yes". This causes the program to proceed, via node 1, to step 98 and the default message list 74 is displayed. At the next step 100, the user selects a message from the default list 74 and the transmitter sends it per step 102.

Referring back to step 96, if the addressee selected in step 94 does not have an associated message list, then the program proceeds to step 98 for displaying the default message list 74 (FIG. 3). Steps 100 and 102 would then be executed as previously described for transmitting a message from the default message list.

It will be clear from the foregoing description that the invention provides a quicker and more convenient way to send customized messages to people with whom one communicates on a somewhat regular basis. No tedious scrolling through long lists of messages is required to find the appropriate message for replying to a received message, or for initiating a new communication.

Although the invention has been described in terms of a preferred embodiment, it will be obvious to those skilled in the art that many alterations and modifications may be made without departing from the invention. Accordingly, it is intended that all such modifications and alterations be considered as within the spirit and scope of the invention as defined by the appended claims.

We claim:

1. A selective call transceiver, comprising:

a memory storing a list of addressees and storing, for each of selected addressees, an associated group of customized messages;

a display for showing messages;

a transmitter for sending messages;

means including a processor for receiving and decoding incoming messages, the processor being coupled to the transmitter, to the display and to the memory, and being programmed to cause the display to show at least some of the customized messages in the group associated with one of the selected addressees; and a user control coupled to the processor for choosing one of the customized messages shown by the display, the processor being responsive to the user control for causing the transmitter to transmit the chosen message to the one selected addressee.

2. A selective call transceiver as set forth in claim 1 wherein the processor is programmed to determine whether a received message is from a sender who is a selected addressee and, if the sender is a selected addressee, to cause the display to show at least some of the customized messages in the group associated with the sender.

3. A selective call transceiver as set forth in claim 2 wherein the memory also stores a default list of messages, and if the sender is not a selected addressee, the processor causes the display to show the default list of messages.

4. A selective call transceiver as set forth in claim 3 wherein the processor is responsive to the user control for causing the transmitter to transmit a selected message from the default list.

5. A selective call transceiver as set forth in claim 2 wherein when a received message includes multiple choices for a reply, the processor causes the display to show the multiple choices prior to showing customized messages.

6. A selective call transceiver as set forth in claim 5 wherein the memory also stores a default list of messages and wherein, when a received message includes multiple choices for a reply, the processor causes the display to show messages from the default list after showing the multiple choices and the customized messages.

7. A selective call transceiver as set forth in claim 1 wherein the memory also stores a default list of messages and wherein, if an addressee is not associated with a group of customized messages, the processor is programmed to cause the display to show the default list of messages.

8. A selective call transceiver, comprising:

a memory storing a list of addressees and storing, for each of selected addressees, an associated group of customized messages;

a display for showing messages;

a transmitter for sending messages;

means including a processor for receiving and decoding an incoming message from a sender, the processor being coupled to the transmitter, to the display and to the memory, and being programmed to determine whether the sender is one of the selected addressees and, if the sender is one of the selected addressees, for causing the display to show at least some of the customized messages in the group associated with the sender; and a user control coupled to the processor for choosing one of the customized messages shown by the display, the processor being responsive to the user control for causing the transmitter to transmit the chosen message to the sender.

9. A selective call transceiver as set forth in claim 8 wherein the memory also stores a default list of messages, and if the sender is not a selected addressee, the processor causes the display to show the default list of messages.

10. A selective call transceiver as set forth in claim 9 wherein the processor is responsive to the user control for causing the transmitter to transmit a selected message from the default list.

11. A selective call transceiver as set forth in claim 8 wherein when a received message includes multiple choices for a reply, the processor causes the display to show the multiple choices prior to showing customized messages.

12. A selective call transceiver as set forth in claim 11 wherein the memory also stores a default list of messages and wherein, when a received message includes multiple choices for a reply, the processor causes the display to show messages from the default list after showing the multiple choices and the customized messages.

* * * * *